US009828981B2

(12) United States Patent
Krebs et al.

(10) Patent No.: US 9,828,981 B2
(45) Date of Patent: Nov. 28, 2017

(54) PUMP UNIT DRIVEN BY AN ELECTRIC MOTOR

(71) Applicant: CONTINENTAL TEVES AG & CO. OHG, Frankfurt (DE)

(72) Inventors: Stephan Krebs, Eschborn (DE); Jens Bacher, Frankfurt am Main (DE); Heinrich Kreh, Florstadt (DE); Lazar Milisic, Kelkheim/Taunus (DE); Michael Jürging, Kelkheim (DE); Marcel Niepenberg, Erzhausen (DE); Jose Gonzalez, Bad Oeynhausen (DE); Karlheinz Seitz, Lorsch (DE); Hans-Michael Koppel, Frankfurt (DE); Falk Petzold, Frankfurt am Main (DE); Rolf Fellinger, Dreikirchen (DE); Stefan Imhof, Oberursel (DE); Thomas Oeffner, Karben (DE); Paul Wiebe, Büttelborn (DE); Manfred Rüffer, Sulzbach (DE)

(73) Assignee: Continental Teves AG & Co. oHG, Frankfurt (DE)

( * ) Notice: Subject to any disclaimer, the term of this patent is extended or adjusted under 35 U.S.C. 154(b) by 654 days.

(21) Appl. No.: 14/373,964

(22) PCT Filed: Feb. 1, 2013

(86) PCT No.: PCT/EP2013/052088

§ 371 (c)(1),
(2) Date: Jul. 23, 2014

(87) PCT Pub. No.: WO2013/113902

PCT Pub. Date: Aug. 8, 2013

(65) Prior Publication Data

US 2015/0030476 A1 Jan. 29, 2015

(30) Foreign Application Priority Data

Feb. 1, 2012 (DE) ..... 10 2012 201 407

(51) Int. Cl.
*F04B 43/00* (2006.01)
*F04B 9/00* (2006.01)
(Continued)

(52) U.S. Cl.
CPC ..... *F04B 43/025* (2013.01); *F04B 9/042* (2013.01); *F04B 9/045* (2013.01);
(Continued)

(58) Field of Classification Search
CPC .. F04B 43/025; F04B 53/102; F04B 39/0044; F04B 43/04; F04B 9/042; F04B 9/045;
(Continued)

(56) References Cited

U.S. PATENT DOCUMENTS 6,135,726 A * 10/2000 Robertson ..... B62D 5/064 417/360
8,182,242 B2 * 5/2012 Harrington ..... F04B 39/0044 248/179.1
(Continued)

FOREIGN PATENT DOCUMENTS

DE 10 2006 008 867 A1 8/2007
DE 10 2007 005 223 A1 9/2007
(Continued)

OTHER PUBLICATIONS

International Search Report for PCT/EP2013/052088 dated Jul. 11, 2013.
German Search Report for 10 2013 201 78.9 dated Oct. 9, 2013.

*Primary Examiner* — Charles Freay
*Assistant Examiner* — Thomas Cash
(74) *Attorney, Agent, or Firm* — RatnerPrestia

(57) ABSTRACT

The invention relates to a pump unit that can be driven by an electric motor, in particular for providing vacuum for a pneumatic brake booster, including a pump housing that can be closed by a working-chamber cover and at least one elastic displacement element, wherein a working chamber is bounded between the displacement element and the working-chamber cover and wherein inlet valves and outlet valves and inlet channels and outlet channels associated with the valves are associated with the working chamber. According to the invention, in order to reduce noise emissions, devices for reducing a contact surface between the working-chamber cover and the pump housing are provided.

20 Claims, 12 Drawing Sheets

(51) Int. Cl.

| | |
|---|---|
| ***F04B 43/02*** | (2006.01) |
| ***F04B 9/04*** | (2006.01) |
| ***F04B 39/00*** | (2006.01) |
| ***F04B 45/04*** | (2006.01) |
| ***F04B 45/047*** | (2006.01) |
| ***F04B 43/04*** | (2006.01) |
| ***F04B 53/10*** | (2006.01) |

(52) U.S. Cl.
CPC ..... *F04B 39/0044* (2013.01); *F04B 39/0055* (2013.01); *F04B 43/04* (2013.01); *F04B 45/04* (2013.01); *F04B 45/047* (2013.01); *F04B 53/102* (2013.01)

(58) Field of Classification Search
CPC .... F04B 39/0055; F04B 45/04; F04B 45/047; F04B 45/043; F04B 43/026; B60T 17/02; B60T 13/569; F16J 3/02
USPC ..... 417/363
See application file for complete search history.

(56) References Cited

U.S. PATENT DOCUMENTS

| | | | | |
|---|---|---|---|---|
| 8,714,941 | B2 * | 5/2014 | Ruffer | B60T 17/02 417/255 |
| 2007/0196217 | A1 * | 8/2007 | Andersen | F04B 27/1081 417/269 |
| 2009/0104052 | A1 * | 4/2009 | Leu | F04B 35/04 417/338 |
| 2010/0096787 | A1 * | 4/2010 | Kojima | F16F 13/101 267/140.13 |

FOREIGN PATENT DOCUMENTS

| | | | | |
|---|---|---|---|---|
| DE | 10 2008 005 820 | A1 | 3/2009 | |
| DE | WO 2010069965 | A1 * | 6/2010 | B60T 17/02 |
| DE | 10 2009 054 499 | A1 | 7/2010 | |
| EP | 0 148 435 | A1 | 7/1985 | |
| JP | H03-289371 | A | 12/1991 | |
| WO | WO 2011/073318 | A1 | 6/2011 | |

* cited by examiner b)

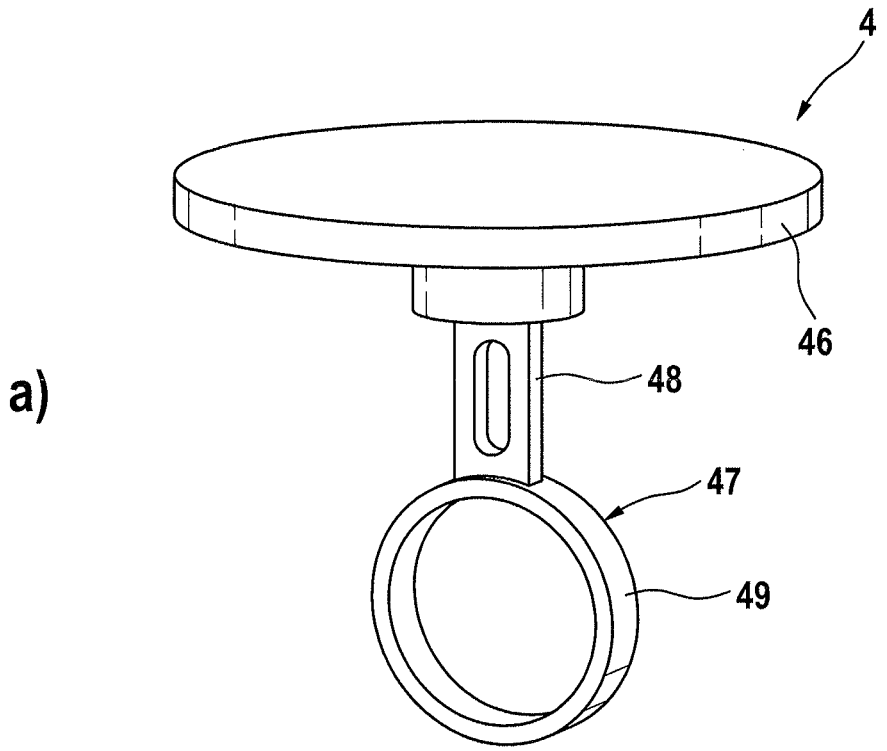
a)
Fig. 14
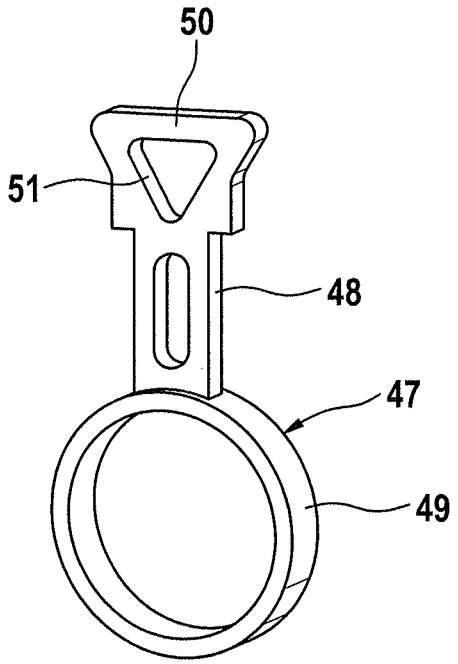
b)

PUMP UNIT DRIVEN BY AN ELECTRIC MOTOR

CROSS REFERENCE TO RELATED APPLICATIONS

This application is the U.S. National Phase Application of PCT/EP2013/052088, filed Feb. 1, 2013, which claims priority to German Patent Application No. 10 2012 201 407.1, filed Feb. 1, 2012, the contents of such applications being incorporated by reference herein.

FIELD OF THE INVENTION

The invention relates to a pump unit that can be driven by electric motor, for the generation of negative pressure for a pneumatic brake force booster, comprising a pump housing that can be closed off by a working chamber cover and comprising at least one elastic displacement element, wherein a working chamber is delimited between the displacement element and the working chamber cover, and said working chamber is assigned in each case inlet and outlet valves and inlet and outlet ducts assigned to the valves.

BACKGROUND OF THE INVENTION

To boost the braking force in hydraulic brake systems, use is made of brake force boosters, wherein a pneumatic or vacuum-type brake force booster is a very widely used, reliable and inexpensive solution.

To generate a vacuum for a pneumatic brake force booster, the interior of which is divided into at least one vacuum chamber and one working chamber, negative pressure is required. In many cases, the required negative pressure can be ensured by means of a connection of the vacuum chamber to an intake pipe of a naturally aspirated internal combustion engine. In the case of diesel, turbocharged or electric drives, and in the presence of an increased braking force demand for example owing to higher vehicle weights, the supply of negative pressure cannot be adequately provided, or cannot be provided at all, by the vehicle drive. To reliably ensure an adequate supply of negative pressure, dedicated vacuum pumps are used which draw residual air out of the vacuum chamber of the brake force booster and discharge said air into the atmosphere.

PRIOR ART

Numerous vacuum pump concepts exist; for example, DE102009054499A1, which is incorporated by reference, discloses a dry-running pump unit that can be driven autonomously by electric motor.

DISADVANTAGES

In the automotive industry, very high demands are set with regard to safety, durability, costs and noise emissions even under extreme driving conditions. Dry-running units in particular are however relatively noisy and necessitate high outlay for sound deadening by way of internal vibration damping and decoupling from the vehicle body. Owing to structural space requirements, pump units that can be driven autonomously may be positioned in a vehicle for example at an installation location where they are at risk of being struck by water, and require protection against contamination in order to protect internal components against corrosion or premature wear as a result of contamination with foreign media.

Because such units in some cases incorporate sound deadening measures into the interior thereof, air outlet units of complex construction are required, and these are considered to have room for improvement with regard to measures for preventing an ingress of water. Furthermore, diaphragm-type pump units, for example, have a relatively complex construction and there is a demand for optimization with regard to producibility and for a reduction in costs and assembly outlay.

SUMMARY OF THE INVENTION

The invention is therefore based on the problem of providing an inexpensive pump unit which exhibits improved noise emissions, is optimized with regard to production and assembly outlay, and exhibits increased reliability.

The problem is solved by virtue of the fact that means are provided for reducing an area of contact between the working chamber cover and the pump housing. The means may preferably be in the form of at least three molded protuberances distributed over the circumference of a housing flange.

It is likewise possible, in a further advantageous embodiment, for the means to be provided on the lower bottom cover flange of a working chamber cover and to be in the form of at least three molded protuberances distributed over the circumference of the lower bottom cover flange, such that spatially stable support, preferably three-point support, can be realized between the working chamber cover and the pump housing.

The means may likewise be provided for reducing a mutual area of contact between a top cover and a bottom cover of a working chamber cover, and may preferably be in the form of at least three molded protuberances distributed over the circumference of a top cover flange or of an upper bottom cover flange, or simultaneously over both flanges, such that spatially stable support, preferably three-point support, can be realized between the top cover and the bottom cover.

It is thus possible to realize spatially stable, geometrically determinate three-point support between the working chamber cover and the pump housing and also within a working chamber cover. This gives rise to a contact pattern that is expedient with regard to vibrations, and sound generation and sound emissions are reduced. Contact pressure is distributed more uniformly in the seal region between the working chamber cover and the pump housing and also within the working chamber cover, whereby the number of fastening points required between the working cover and the pump housing, and thus also production costs and assembly outlay, can be reduced.

In one advantageous refinement of the invention, the working chamber cover may be separated from the pump housing, and/or the top cover may be separated from the bottom cover, by means of at least one elastic decoupling element for the purpose of reducing a transmission of vibrations. In addition to a regular seal element, it is possible, for example, for a thin elastomer or polymer foil to be arranged in a contact region of the molded protuberances and of the counterpart component. In this way, the transmission of sound in the contact regions is reduced yet further, acoustic decoupling is improved, and the sound emission characteristics are attenuated and lessened. It is likewise conceivable for multiple individual sub-elements to be provided in order to isolate individual regions on the respectively corresponding flanges against direct contact with a molded protuberance.

In a further advantageous refinement of the invention, the described decoupling element may be connected to at least one or more seal elements to form a single gasket, thus promoting a simple assembly process and eliminating assembly errors.

In a further advantageous embodiment of the invention, it is possible, within a working chamber cover, for at least one insert part that can be loaded in the valve opening direction by a valve plate to be arranged, so as to be secured against rotation, in an inlet duct or an outlet duct or in both ducts. In this way, it is for example possible for the bottom cover to be produced in a particularly simple manner by punching or deformation, which can considerably reduce unit costs owing to cheaper tools and starting materials and higher cycle times. The insert part can be injection-molded from plastic in a simple and inexpensive manner and, in the assembled pump unit, can serve for the support of a valve disk or valve plate. A particularly expedient design of impact surfaces for the abutment of the valve plate during the valve opening process is made possible in an inexpensive manner.

It is accordingly possible, in a particularly advantageous embodiment, for the insert part to have at least one impact surface, which is rounded in a valve opening direction, for the abutment of the valve plate during the valve opening process. In this way, noise generation at the valves during the operation of the pump unit can be reduced considerably.

In one advantageous refinement of the invention, the insert part may be equipped with means for locking the insert part, which means engage into locking openings provided for the purpose. It is preferably possible for locking openings of said type to be provided in the bottom cover, which does not increase the complexity of the manufacture of the bottom cover and nevertheless permits simple and effective locking of the insert part.

In a further advantageous embodiment, a valve support surface for the support of a valve plate in a closed valve state may have at least one recess for reducing an area of contact between the valve plate and the valve support surface. Here, it is possible for the above-described recess to be arranged both on the bottom cover and on the top cover. As a result of a reduction in the area of contact between the respective valve plate and the valve support surface, and the associated back-ventilation of the valve plate, the impact noise of the valve plate against the valve support surface can be reduced considerably. A tendency of the valve plate to adhere to the valve support surface is counteracted in an effective manner. As a result, the valve operates altogether more smoothly and more quietly.

In a particularly advantageous embodiment of the working chamber cover according to the invention, the top cover may be shaped such that a length of its outer contour directed toward the bottom cover is significantly smaller than a length of an outer contour of the corresponding bottom cover. In this way, the top cover can be reduced substantially to just an encasement of the inlet and outlet ducts and valves. This yields great savings in terms of material, weight and structural space. Furthermore, the manufacture and assembly both of the top cover and also of the bottom cover can be simplified, and the number of fastening points can be drastically reduced. Furthermore, the inlet ducts and outlet ducts can be configured so as to be of particularly streamlined form.

In another advantageous embodiment, the pump unit can be fastened in elastically vibration-decoupled fashion in a base holder, wherein the elastic decoupling can be realized by means of damping elements, and wherein the base holder has supporting elements for receiving damping elements, and wherein at least one supporting element is manufactured by deformation of the base holder. The integrated support elements, generated by the deformation process, on the base holder make it possible for damping elements to be received and positioned directly, without the need for further intermediate elements, for example screws or bolts. It is thus possible to dispense with separate supporting elements, whereby both the number of parts and also the number of assembly operations required can be reduced. Furthermore, the base holder is additionally stiffened, and thus improved in terms of its acoustic sound emission characteristics.

In a further advantageous embodiment, a damping element may have an inner shell with a conical inner contour and an outer shell, wherein the inner shell may be connected to the outer shell by an encircling collar, which is directed obliquely with respect to the axis of rotation of the damping element, and by the radial webs that are arranged at least on one side of the collar.

By means of the described form, it is possible to provide a damping element that has a particularly pronounced progressive spring characteristic. The damping element generates a particularly low resistance force in the presence of low loads or deformations, whereas it generates a particularly high resistance force in the presence of intense deformations. In this way, the damping element can provide effective damping over a broad load and vibration spectrum, and can thus realize effective decoupling of the pump unit with relatively little outlay.

In a further advantageous embodiment, an intermediate base, which is provided with passage openings, of an air outlet unit provided for the discharge of the air into the surroundings of the pump unit may be equipped with means that are suitable for closing the passage openings in the manner of a check valve, and preferably in water-tight fashion.

In one advantageous refinement, said means may be in the form of an elastically resilient tab that is integrally formed on the intermediate base. In this way, effective protection against an ingress of water into the housing interior of the pump unit can be realized in a particularly simple and inexpensive manner without additional assembly steps. The above-mentioned tab can, in an effective manner, prevent water that has ingressed into the air outlet unit from the outside through the passage openings from passing onward into the housing interior of the pump unit through the passage openings and causing a malfunction or damage.

In a further advantageous embodiment, the elastic valve disk of a check valve arranged within the air outlet unit can be loaded counter to the valve opening direction by means of an elastic element, wherein the elastic element may preferably be in the form of a spiral spring. In this way, an undesired opening of the check valve, for example owing to chattering of the valve disk or owing to unpredictable pressure difference fluctuations, can be counteracted in an effective manner. Furthermore, the protection afforded by the check valve against an ingress of water into the housing interior from the surroundings of the pump unit is improved considerably.

In one advantageous refinement of the invention, it is furthermore possible for a disk element to be arranged between the elastic element and the valve disk; this promotes a particularly uniform distribution of the pressure force of the valve disk on the valve seat, and thus uniform quiet opening and closing of the check valve.

In a further advantageous embodiment of the invention, it is possible for at least two elastic intermediate elements to be interposed, so as to act in parallel, between the pump housing and the drive unit that drives the pump unit, wherein an inner intermediate element is provided for pneumatic and hydraulic sealing with respect to the surroundings of the pump unit, and an outer intermediate element contributes primarily to the vibration decoupling of the drive unit from the pump housing.

In an advantageous refinement, the intermediate elements may be connected to one another by at least two, and preferably four, elastic connecting webs.

In this way, a transmission of vibrations between the drive unit and the pump housing can be reduced in an effective manner without impairment of the seal function, and an assembly operation can be simplified.

In a particularly advantageous embodiment of the invention, the displacement element may comprise a connecting rod element and a diaphragm element, the latter being non-detachably connected to the connecting rod element by means of an insert molding process. Here, the connecting rod element may be produced in one piece in a particularly simple and inexpensive manner from a plastics material preferably in an injection molding process, and may have a connecting rod ring part integrated therein. In this way, the displacement element can not only be produced in an inexpensive and effective manner in only a small number of process steps, but can also exhibit a particularly low weight. In this way, the vibration characteristics of the crank drive can be improved, noise emissions can be reduced overall, and the mass of the pump unit can be reduced.

DESCRIPTION OF THE FIGURES

Further details, features, advantages and possible uses of the invention will emerge from the subclaims together with the description and with reference to the drawings. Corresponding components and structural elements are denoted, where possible, by the same reference signs. In the drawings:

FIGS. 14*a* and 14*b* show an embodiment according to the invention of a displacement element, and a detail illustration of a connecting rod element.

DETAILED DESCRIPTION OF THE INVENTION

Because basic functional principles of generic pump units and of pneumatic brake force boosters that can be connected to such pump units are well known, a precise explanation of these will not be given below unless considered essential to the description of the invention.

FIG. 1

Figure 1:
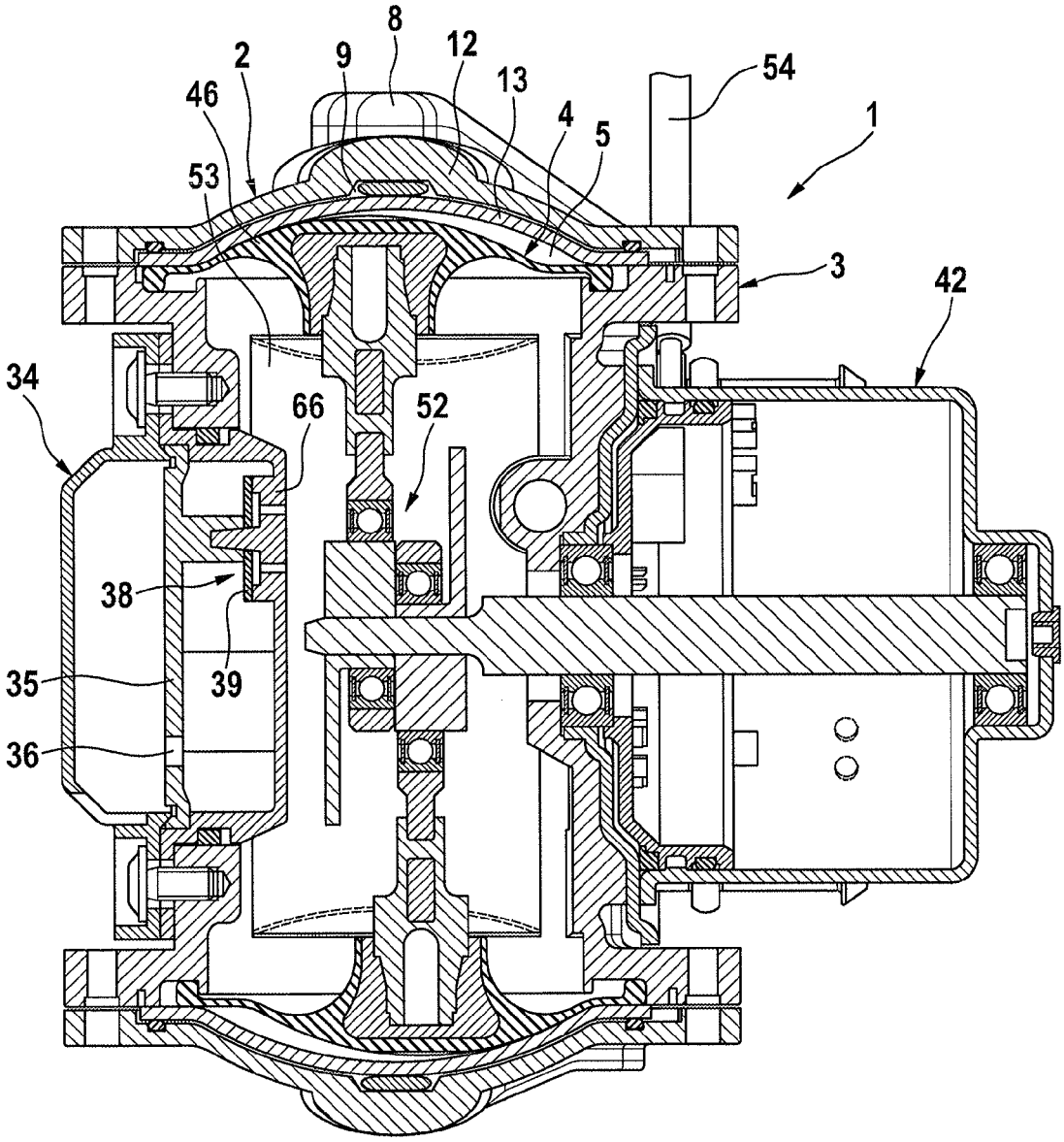
FIG. 1 shows a known pump unit in a sectional illustration.

FIG. 1 shows a known pump unit 1. The pump unit is in the form of a double-diaphragm pump with two opposite displacement elements 4. The displacement elements 4 each have an elastic diaphragm element 46 which are each clamped in air-tight fashion between a pump housing 3 and a working chamber cover 2 and thereby delimit a working chamber 5. Each working chamber is assigned a respective inlet 6 and outlet valve 7 (not shown) and inlet 8 and outlet ducts 9 that are pneumatically connected to the valves. Here, the inlet duct 8 is pneumatically connected to a connection line 54 that is connected to a pneumatic brake force booster (not shown). Via said connection, air is drawn out of a negative-pressure chamber of the brake force booster into the working chamber 5.

The outlet duct 9 is pneumatically connected to a housing interior 53 of the pump unit. From the housing interior 53, the air is discharged into the surroundings via an air outlet unit 34. The air outlet unit 34 is divided by an intermediate base 35 with passage openings 36, and comprises further structural elements such as a check valve 38, which is arranged between an air outlet unit base 66 and the intermediate base 36 and which prevents an ingress of air into the housing interior 53.

The displacement elements 4 are moved in opposite directions by means of a crank drive 52 such that, as a result, a volume of the working chamber 5 is periodically varied and thus, in interaction with the inlet and outlet valves, a transfer of air is effected from a connected brake force booster into the surroundings of the pump unit via the working chamber 5.

The crank drive 52 is set in motion by means of an electronically controllable drive unit 42.

FIG. 2

Figure 2:
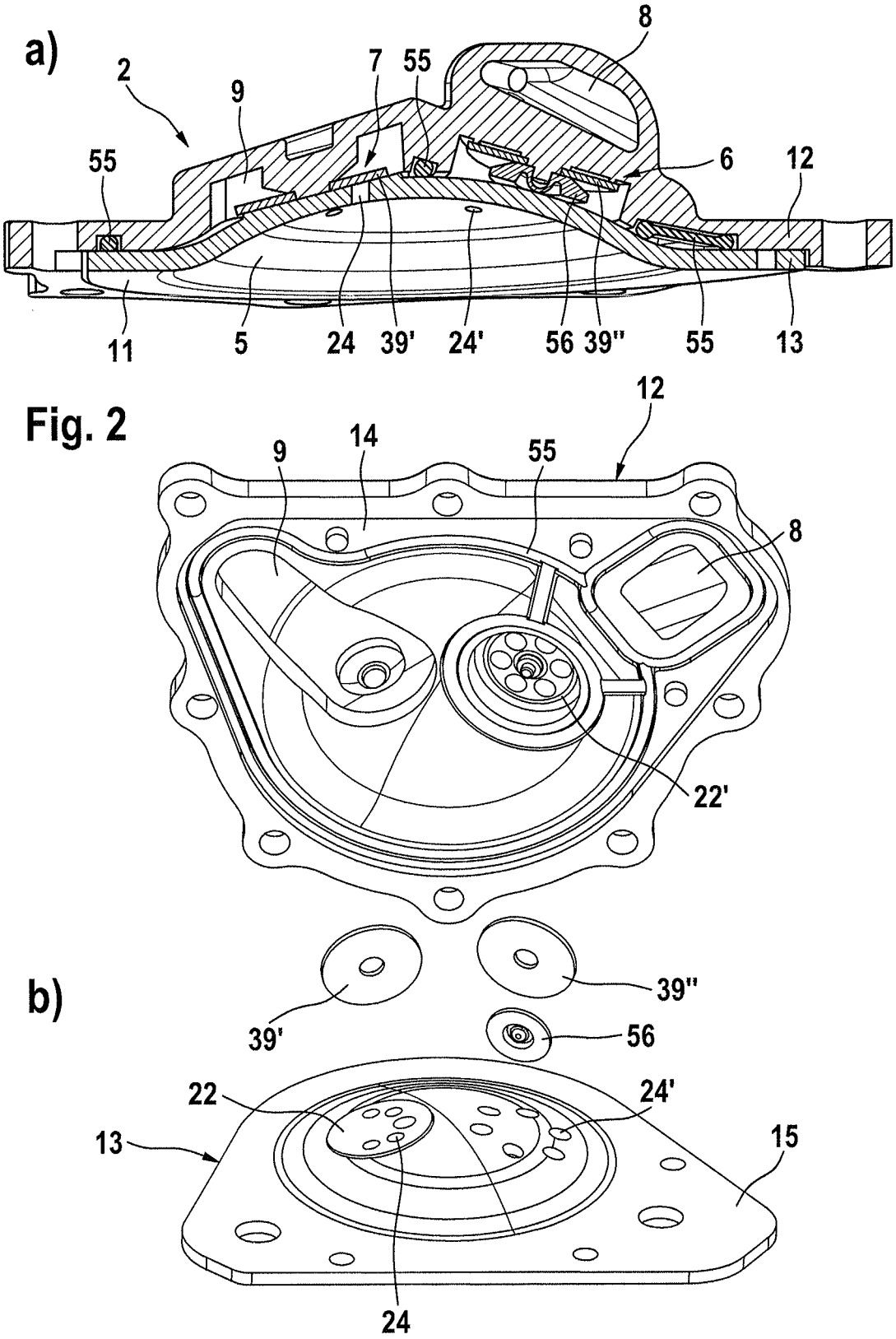
FIG. 2 shows a known working chamber cover in a sectional illustration (a) and in an exploded illustration (b).

To illustrate the valve function, FIG. 2 shows a known working chamber cover 2 in a sectional illustration (a) and in an exploded illustration (b). The working chamber cover 2 comprises a relatively large top cover 12 and a relatively small bottom cover 13, wherein the top cover 12 has an inlet duct 8 and an outlet duct 9 integrated therein. The inlet duct 8 is assigned an inlet valve 6, and the outlet duct 9 is assigned an outlet valve 7. The two valves are each in the form of check valves with elastic valve disks 39', 39" which, in a closed valve position, bear sealingly against respectively associated valve support surfaces 22, 22'. A combination seal 55 ensures air-tight separation between the top cover 12 and the bottom cover 13 in the region of a top cover flange 14 and of an upper bottom cover flange 15, and also between the inlet duct 8 and the outlet duct 9.

By means of a lower bottom cover flange 11, the working cover 2 presses the diaphragm element 46 shown in FIG. 1 against the pump housing 3 in a pneumatically sealed manner, and thus ensures a pneumatic delimitation of the working chamber 5. Air ducts 24, 24' extending through the bottom cover 13 permit a connection of inlet 8 and outlet ducts 9 to the working chamber 5.

FIG. 3

Figure 3:
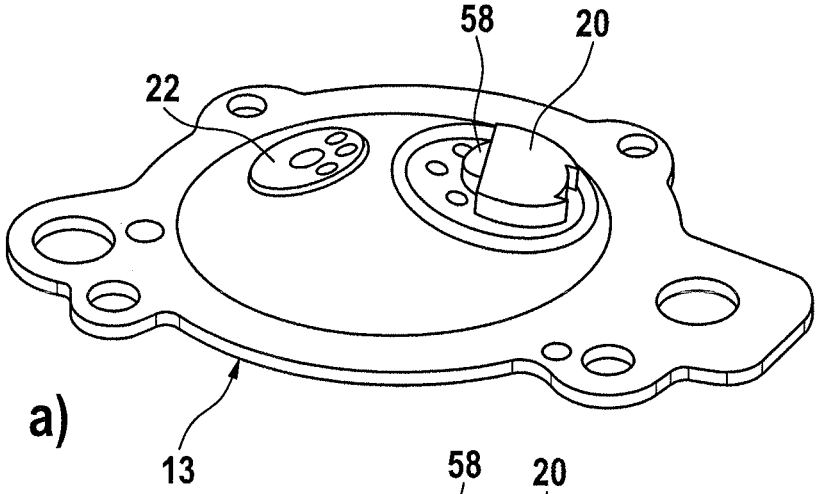
FIGS. 3*a* and 3*b* show an embodiment according to the invention of a bottom cover.
Figure 3:
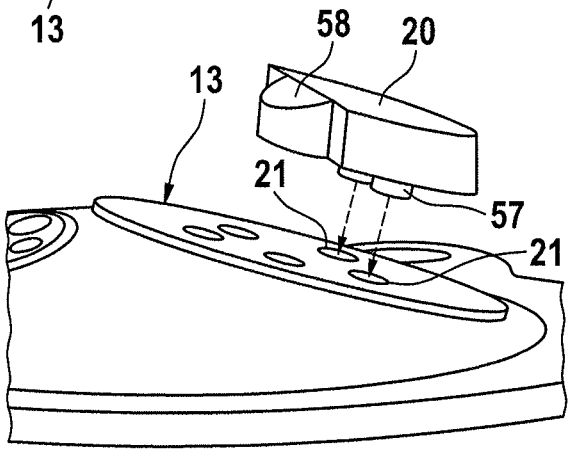

For the support of a valve disk during the opening process of a generic valve as per FIG. 2, an impact surface is generally required. In the known embodiment as per FIG. 2, this is realized, in the case of the inlet valve, by means of an impact element 56 which is connected to the top cover 12 and which clamps the valve disk 39". In an embodiment according to the invention of a bottom cover 13 as shown in FIG. 3, said function is realized by means of a separate insert part 20. The insert part 20 has two locking lugs 57 which are plugged into the locking openings 21 provided for the purpose in the bottom cover 13 and are thus locked so as to be secured against rotation. It is thus possible for both the bottom cover and also the top cover to be designed such that they can be produced considerably more easily, for valve disks to be replaced by simple valve plates 19 connected to the combination seal 55, and for the impact surface 58 to be configured such that sound generation during the impacting of the valve disk or valve plate can be reduced.

FIG. 4

Figure 4:
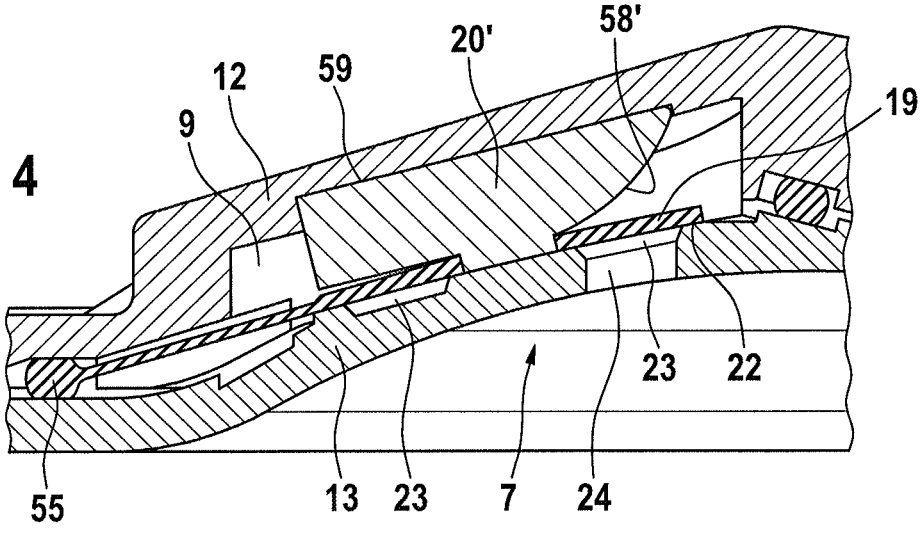
FIG. 4 shows a sectional detail illustration of a further embodiment according to the invention of a working chamber cover.

FIG. 4 shows a further embodiment according to the invention, in which an insert part 20' assigned to the outlet valve 7 is inserted into a recess 59, provided for the purpose, in the top cover 12 and provides, for the valve plate 19 connected to the combination seal 55, a rounded impact surface 58' for abutment during the opening of the valve. The impact surface 58' is abutted against by the valve plate 19 when the outlet valve opens and a flow takes place from the working chamber 5 into the outlet duct 9. It is preferable for the impact surface 58' to be rounded with a radius R=10 mm, though it is also possible for other adequately large values to be selected in order that, firstly, particularly quiet impacting of the valve plate 19 is made possible and, secondly, the tendency for flow separation from a sharp body edge is reduced in an effective manner. It is furthermore possible, within the scope of the invention, for the insert part 20' to be provided with further means for locking in the top cover 12, for example similar to those in FIG. 3.

In the closed valve state, the valve plate 19 bears against the valve support surface 22. Said valve support surface 22 has an encircling recess 23. In this way, the area of contact between the valve support surface 22 and the valve plate 19 is reduced, and a tendency of the elastic material of the valve plate 19 to adhere or stick to the valve support surface 22 is thereby reduced in an effective manner. Furthermore, the air flowing out of the working chamber 5 through the air ducts 24 is split up in the recess 23 and acts on the valve plate 19 more uniformly and over a greater effective area. During the closing process, the impact noise of the valve plate 19 against the valve support surface 22 is likewise reduced owing to back-ventilation and a reduction in the area of contact. In this way, the valve operates altogether more smoothly and more quietly. It is self-evident that, within the scope of the invention, the recess 23 may also assume shapes other than the encircling trapezoidal profile that is shown.

FIG. 5

Figure 5:
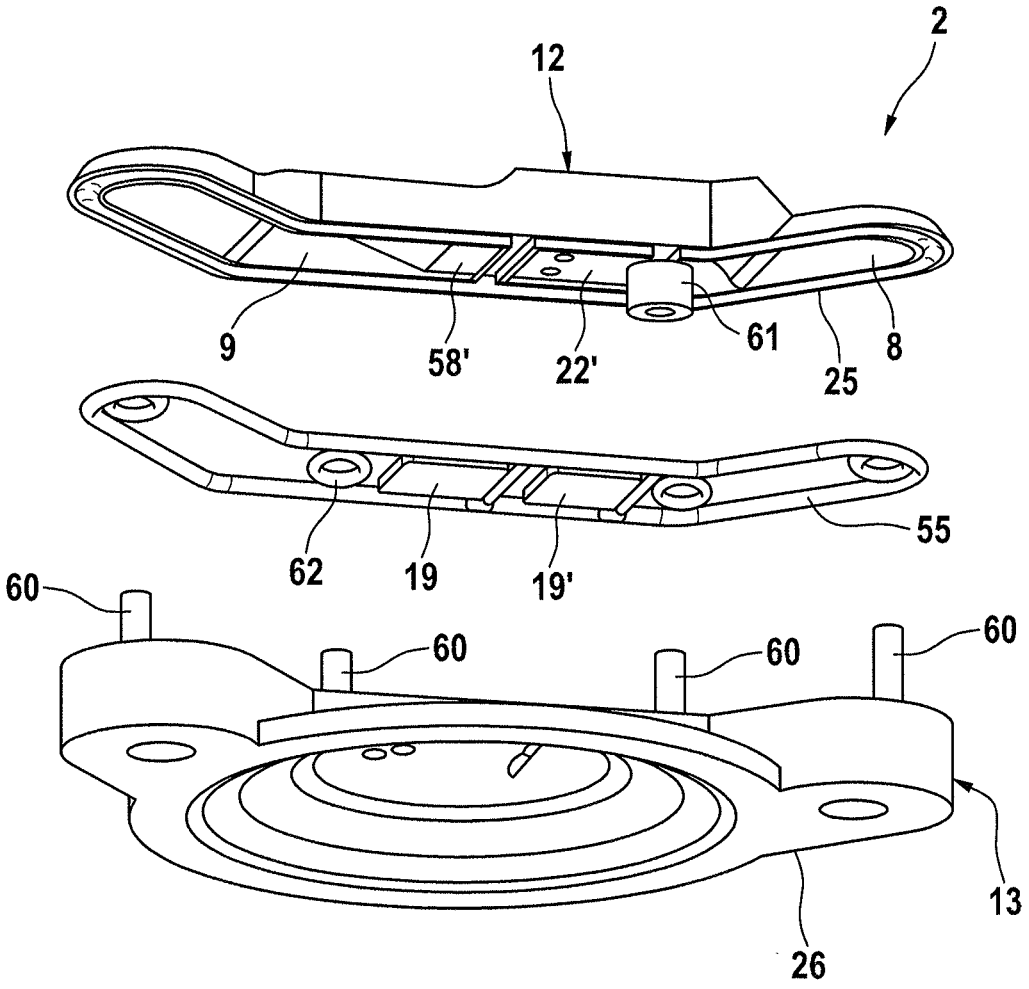
FIG. 5 shows a further embodiment according to the invention of a working chamber cover in an exploded illustration.

FIG. 5 shows another embodiment of a working chamber cover 2 according to the invention in an exploded illustration.

By contrast to the embodiments described in the introduction, the top cover 12 is of elongate shape and, in terms of form, is substantially reduced to a tunnel-like encasement of the inlet duct 8 and of the outlet duct 9 and has an impact surface 58', of integrated form, for the outlet valve 7 and a valve support surface 22' for the inlet valve 6. By contrast to the embodiments described in the introduction, the length of the outer contour 25 of the top cover 12 is in this case considerably shorter than the length of the outer contour (26) of the bottom cover 13. It is thus possible for the working cover 2 to be made altogether considerably simpler and more lightweight and for the air ducts to be optimized in terms of flow. In the embodiment shown, the combination seal 55 is of very simple and space-saving form and has the valve plates 19 and 19' integrated therein.

The bottom cover 13 receives the combination seal and is equipped with positioning studs 60 which serve primarily for the positioning of the top cover 12 on the bottom cover 13 and which may additionally be provided for absorbing longitudinal and transverse forces between said two cover parts by virtue of said positioning studs engaging into the corresponding stud guides 61 integrally formed on the top cover 12. It is likewise possible for the positioning studs 60 to be used, by virtue of their being deformed after the mounting of the top cover 12, for permanently fixing the top cover 12 to the bottom cover 13. For sealing of the studs, the combination seal 55 has integrated O-rings 62 which engage around the positioning studs 60 in the assembled state. The O-rings 62 can sometimes stiffen the combination seal 55 overall and stabilize it against deformations and thus contribute, overall, to a reliable and simple assembly operation.

FIG. 6

Figure 6:
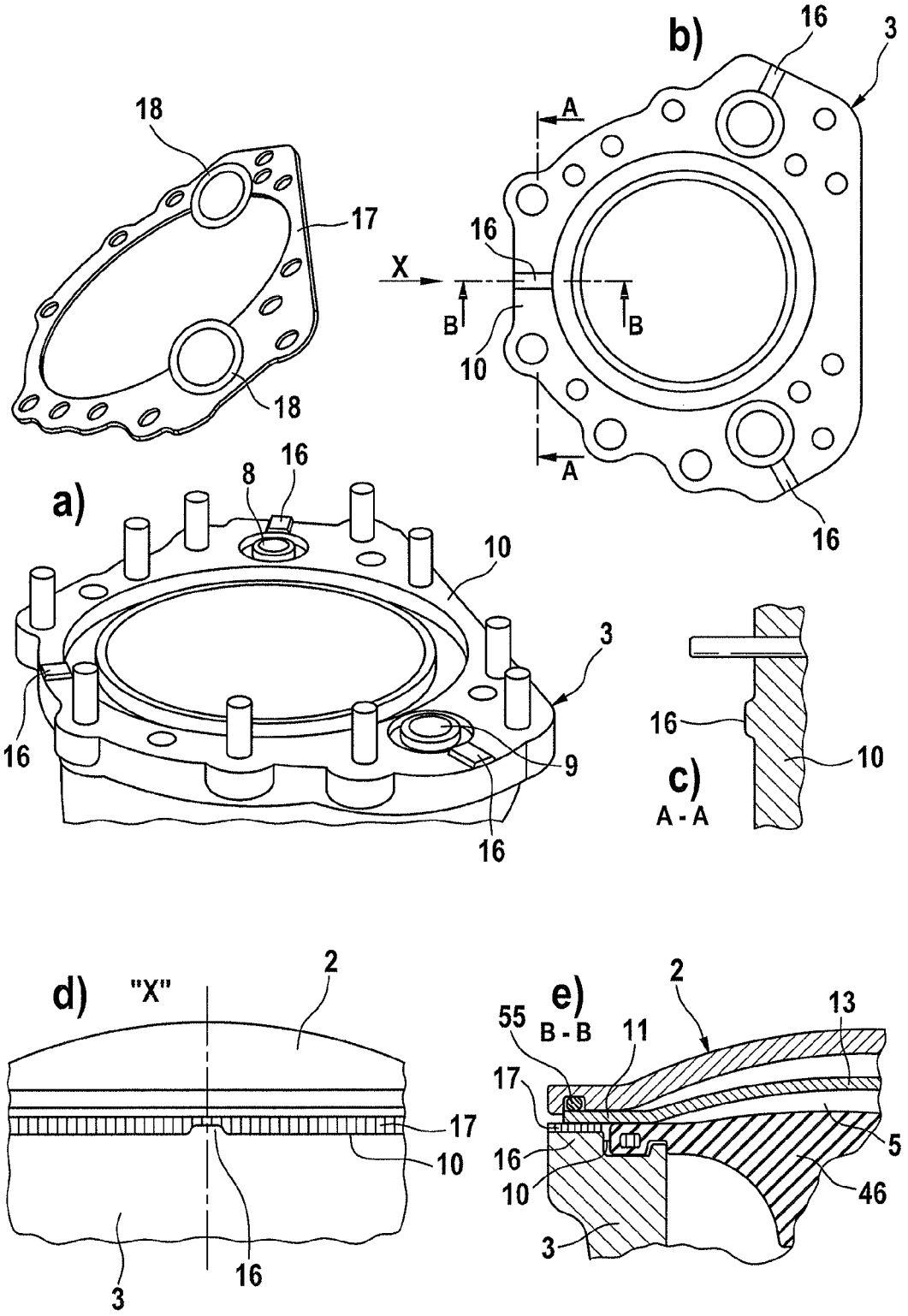
FIGS. 6*a*-6*e* show an embodiment according to the invention of a pump housing, and sectional detail illustrations of the assembled state.

FIG. 6 shows details of an embodiment of the pump unit according to the invention. The view **6*a* illustrates a three-dimensional oblique view of a housing flange 10 of the pump housing 3. The surface of the housing flange 10 has three molded protuberances 16 that are distributed over the circumference so as to be substantially uniformly spaced from one another. The molded protuberances 16 prevent the working chamber cover 2 (not shown) from bearing against the pump housing 3 over a large area. An area of contact between the pump housing 3 and the working chamber cover 2 (not shown) is reduced and, in the assembled state, is thus restricted to the three punctiform contact regions of the molded protuberances 16, which are small in relation to the area of the housing flange 10. Without the inserted diaphragm element 46 (see FIG. 1, FIG. 6*e*), a defined air gap would remain at all other points between the working chamber cover 2 and the pump housing 3. Three-point support thus exists between the working chamber cover 2 and the pump housing 3**.

During operation of the pump unit 1, noises or sound waves are generated both in the working chamber cover 2 and also in the pump housing 3, said noises or sound waves then being radiated through all of the existing surfaces. Noises at and in the working chamber cover 2 are generated primarily owing to air turbulence at the valves 6, 7 and in the air ducts 8, 9, and are normally of a higher frequency than noises at and in the pump housing 3, which originate primarily from the drive unit 42 and from the mechanical crank drive 52. At all of the areas of contact between the working chamber cover 2 and the pump housing 3, the sound waves are transmitted and repeatedly superposed on one another, which can give rise, for example, to undesired resonance.

Owing to the high contact pressure in the areas of contact between the molded protuberances 16 and the working chamber cover 2 and the elimination of further sound-transmitting areas of contact, sound transmission effects between the working chamber cover 2 and the pump housing 3 are reduced, and resonance is prevented. Sound emissions both from the working chamber cover 2 and also from the pump housing 3 are likewise reduced considerably. To further intensify this expedient effect, a thin elastic decoupling element 17 is provided which is arranged between the working chamber cover 2 and the pump housing 3 and which both reduces a direct transmission of sound from one to the other counterpart at the 3 above-mentioned areas of contact and also permits extensive sound decoupling. In the exemplary embodiment shown, the decoupling element 17 is in the form of an elastomer foil and is connected to two seal elements 18 so as to form a single gasket. The two seal elements 18 serve for the sealing of the inlet duct and of the outlet duct at their parting point between the working chamber cover 2 and the pump housing 3.

In a further embodiment according to the invention, it is however also possible to dispense with a decoupling element of said type.

It is known that, in a three-dimensional space, three-point support constitutes a spatially stable and mathematically determinate mounting configuration of a body, because a center of mass of the body is situated within a virtual triangle, the ends of which are the support points. Because, in a three-dimensional space, it is furthermore the case that more than three vectors are always linearly dependent, it would, in the presence of more than three support points, be more cumbersome from a production aspect to ensure simultaneous and uniform contact at all of the support points. Within the scope of the invention, it is nevertheless also possible to provide more than three molded protuberances in order, for example, to limit material loads as a result of high contact pressure in the contact regions, and nevertheless reduce sound transmission and sound emission effects.

The pump housing 3 shown in FIG. 6*a* is shown in FIG. 6*b* in a plan view, and in FIG. 6*c* in a section A-A through the pump housing 3. FIG. 6*d* shows the view X and FIG. 6*e* shows the section B-B from FIG. 6*b*, but in the case of an assembled pump unit 1.

FIG. 6*b* illustrates that the molded protuberances 16 are arranged, so as to be substantially uniformly spaced from one another, on an outer edge of the housing flange 10 and provide an area of contact, which is very small in relation to the total area of the housing flange 10, for the support of the working chamber cover. From the view c, it can be seen that the molded protuberances 16 project only slightly beyond the surface of the housing flange 10.

FIG. 6*d* shows a detail of a side view of an assembled pump unit 1. The decoupling element 17 is arranged between the working chamber cover 2 and the pump housing 3, said decoupling element being compressed in the region of the molded protuberance 16. From FIG. 6*e* in particular, it can be seen that the working chamber cover 2 is supported by way of the lower bottom cover flange 11 on the pump housing 3 and that the sealing of the working chamber 5 with respect to the surroundings of the pump unit is performed primarily by the elastic diaphragm element 46, which, at its edge which is thickened and stiffened in bead-like form, is sealingly compressed and clamped between the bottom cover 13 and the pump housing 3. The decoupling element 17 serves primarily for sound decoupling at an area of contact between the bottom cover 13 and the molded protuberance 16. The housing flange 10 runs below the above-mentioned area of contact, with a spacing to the bottom cover 13.

FIG. 7

Figure 7:
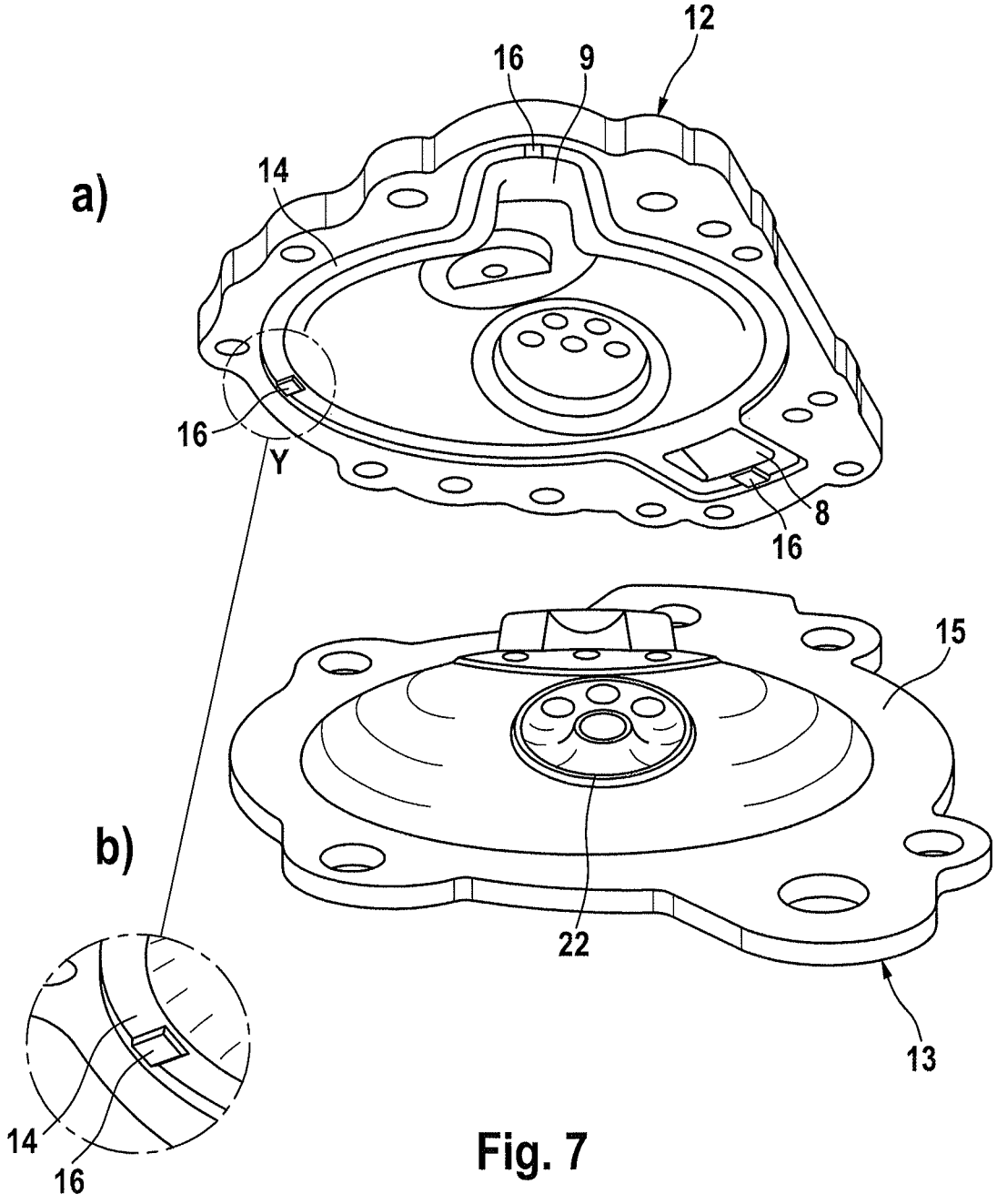
FIGS. 7*a* and 7*b* show a further embodiment according to the invention of a working chamber cover.

FIG. 7 shows a further exemplary embodiment according to the invention of a top 12 and bottom cover 13 of a working chamber cover 2. In the case of a known embodiment, the top cover 12 and the bottom cover 13 are in contact over the entire circumference of the top cover flange 14 or of the upper bottom cover flange 15. In the embodiment illustrated, it is the case, by contrast, that the top cover has three molded protuberances 16 arranged in substantially uniformly distributed fashion on the top cover flange 14, which molded protuberances, in accordance with the principle already described above, permit three-point support between the top cover 12 and the bottom cover 13 and thus generate intensive acoustic decoupling. Within the scope of the invention, it is also possible for more than three molded protuberances 16 to be distributed on the top cover flange 14 or to be additionally or exclusively provided on the upper bottom cover flange 15 in order, for example, to optimize force profiles in the assembled state or the production of individual components. It is likewise conceivable for the molded protuberances to be provided exclusively on the lower bottom cover flange 11, or provided on the latter in addition to the molded protuberances 16 on the housing flange 14 (FIG. 6).

FIG. 8

Figure 8:
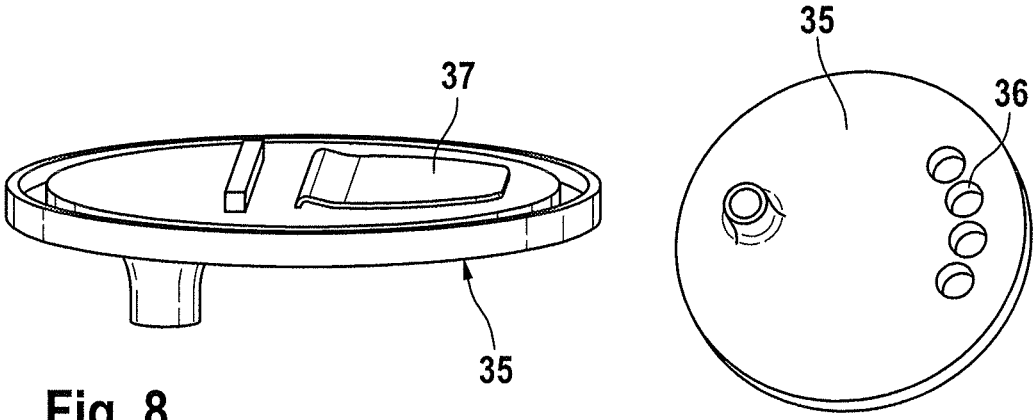
FIG. 8 shows an embodiment according to the invention of an intermediate base for an air outlet unit.

FIG. 8 shows an embodiment according to the invention of an intermediate base 35 shown in FIG. 1. The intermediate base 35 is manufactured from a flexible material and has a likewise flexible tab 37 integrally formed on the intermediate base 35. The tab 37 is designed such that, in its relaxed normal state, it bears areally against the surface of the intermediate base 35 and covers, or closes off, the passage openings 36 in the direction of the housing interior 53 and thus in the direction of the outlet duct 9. In the event of an air shock caused by a movement of the displacement element 5, a pressure difference is built up on the two sides of the intermediate base 35, said pressure difference forcing the tab 37 to lift from the surface of the intermediate base 35 and thus open up the passage openings 36. At the same time, the tab 37 is elastically preloaded.

After a certain amount of air has escaped through the passage openings 36, the pressure difference decreases, and the tab 36 springs back elastically, thus closing the passage openings 36 and preventing the ingress of air, dirt and moisture into the housing interior 53. The sound emissions from the housing interior 53 are also reduced as a result of the closure of the passage openings 36. In the event of an ingress of relatively large amounts of water into the air outlet unit 34, the water surge that has ingressed causes the tab 37 to be pressed with even greater intensity against the passage openings 36, with said tab thus preventing a further advancement of moisture in an effective manner.

Further structural designs of the tab are also conceivable within the scope of the invention:

In the embodiment shown, the tab 37 is in the form of a single, foldable integrally molded portion on the intermediate base, though it is likewise possible for more than one tab to be provided which is assigned to the individual passage openings 36 or groups of passage openings 36.

It is likewise possible, for example, for the tabs 37 to be provided not so as to be integrally formed on the intermediate base 35 but so as to be rotatably mounted thereon and pressed against the surface of the intermediate base by means of an elastic element.

FIG. 9

Figure 9:
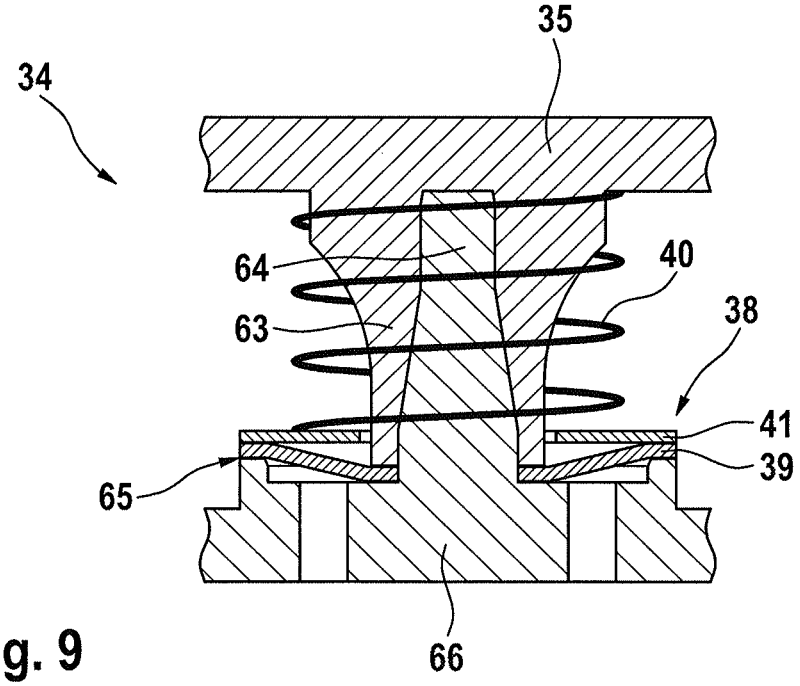
FIG. 9 shows an embodiment according to the invention of a check valve for an air outlet unit.

FIG. 9 shows an embodiment according to the invention of a check valve 38 which is arranged between the intermediate base 35 and the air outlet unit base 66 and which ensures that the air discharged from the working chamber 5 can pass out of the housing interior 53 through the air outlet unit 34 into the surroundings of the pump unit 1, but not back in again. The intermediate base 35 has an integrally molded sleeve 63 which engages around a conical pin 64 that is arranged on the air outlet unit base 66 centrally within the valve seat 65, with said sleeve simultaneously pressing the elastic valve disk 39 against the valve seat 65. The valve disk 39 is additionally subjected to load by an elastic element 40 in the form of a spiral spring that is supported against the intermediate base 35. To ensure a uniform distribution of the pressure force over the entire circumference of the valve disk 39 and thus reliable closure of the check valve 38, a rigid disk element 41 is interposed between the elastic element 40 and the valve disk 39.

An undesired opening of the check valve 37, for example owing to chattering of the valve disk 39 or unpredictable pressure difference fluctuations owing to interactions with the tab 37 described above, is thus counteracted.

The described additional elastic support of the valve disk 39 between the valve seat 65 and the intermediate base 35 furthermore considerably improves the protection afforded by the check valve against an ingress of water into the housing interior 53 from the surroundings of the pump unit 1.

FIG. 10

Figure 10:
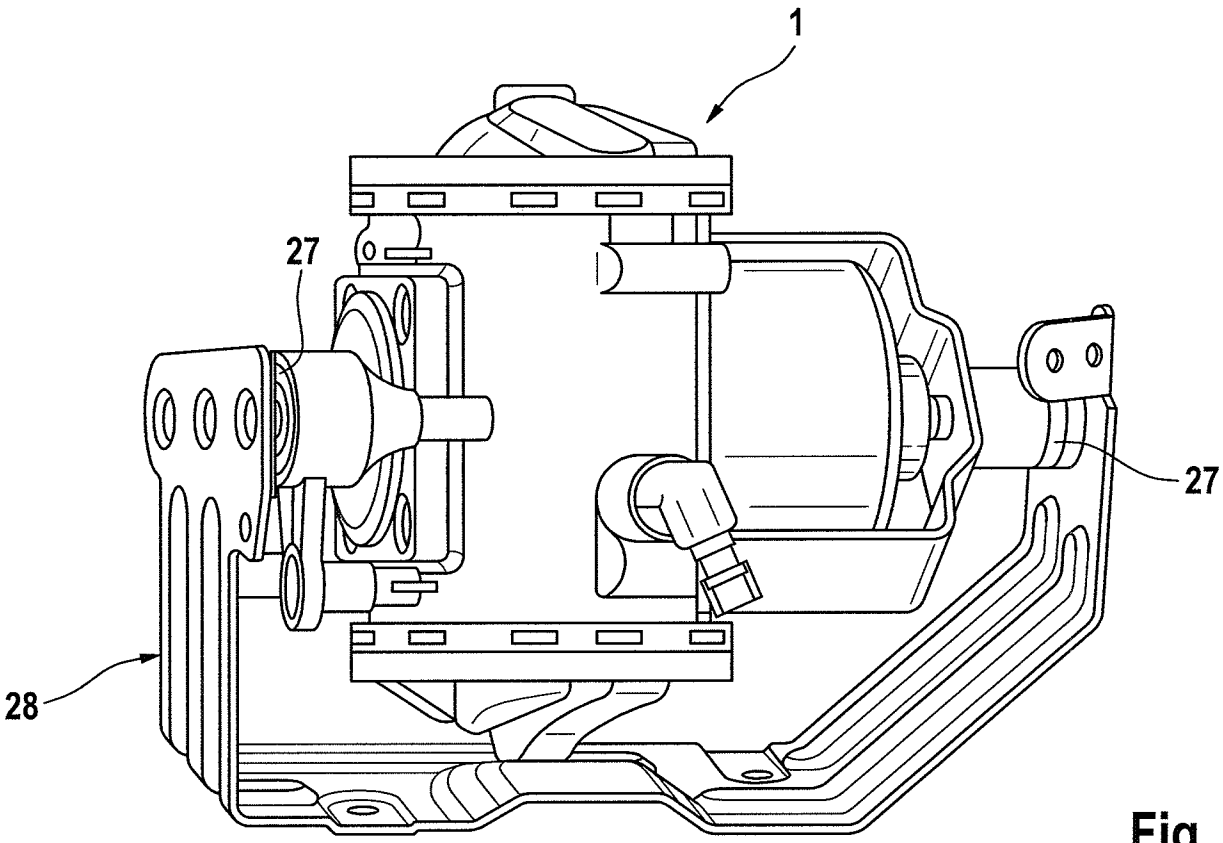
FIG. 10 shows a pump unit mounted in a base holder.

FIG. 10 shows the pump unit 1 mounted or suspended in a base holder 28. The base holder 28 serves for the fastening of the pump unit 1 fixedly to a vehicle body. For vibration decoupling, elastic damping elements 27 are interposed between the pump unit 1 and the base holder 28. The pump unit 1 thus exhibits restricted freedom of movement in and around all spatial directions.

FIG. 11

Figure 11:
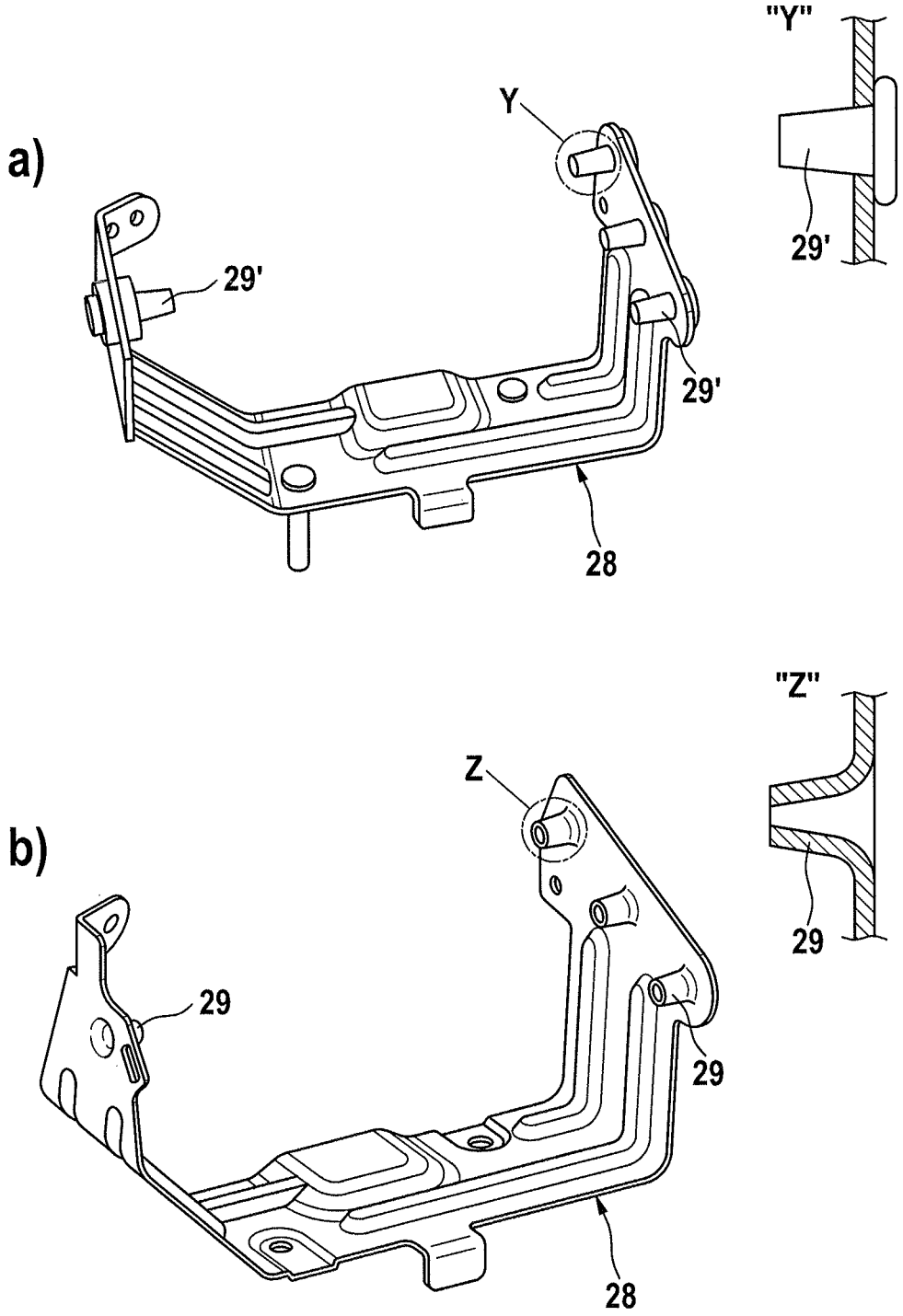
FIG. 11 shows an embodiment according to the invention of a base holder (b) in comparison with a known base holder (a).

FIG. 11 shows a known embodiment (view a) and an embodiment according to the invention (view b) of the base holder 28 in a three-dimensional illustration.

To receive damping elements 27, the base holder 28 has supporting elements 29, 29'. The supporting elements 29' of the known embodiment are formed as separate components which, in a separate joining process, are inserted into the openings provided for them in the base holder. By contrast, the embodiment according to the invention as per FIG. 1*lb* has support elements 29 which are integrated in the base holder 28 and which are generated by deformation of the base holder blank, for example by deep drawing or pressing processes.

If required, support elements 29 formed in this way may for example be provided with a rolled or cut internal thread, for example in order to serve as a fixing point for plug connectors, cable holders or other peripheral elements or units.

Further exemplary embodiments of integrated support elements generated by deformation processes—for example by means of punching and bending, or upsetting—are likewise conceivable within the scope of the invention.

FIG. 12

Figure 12:
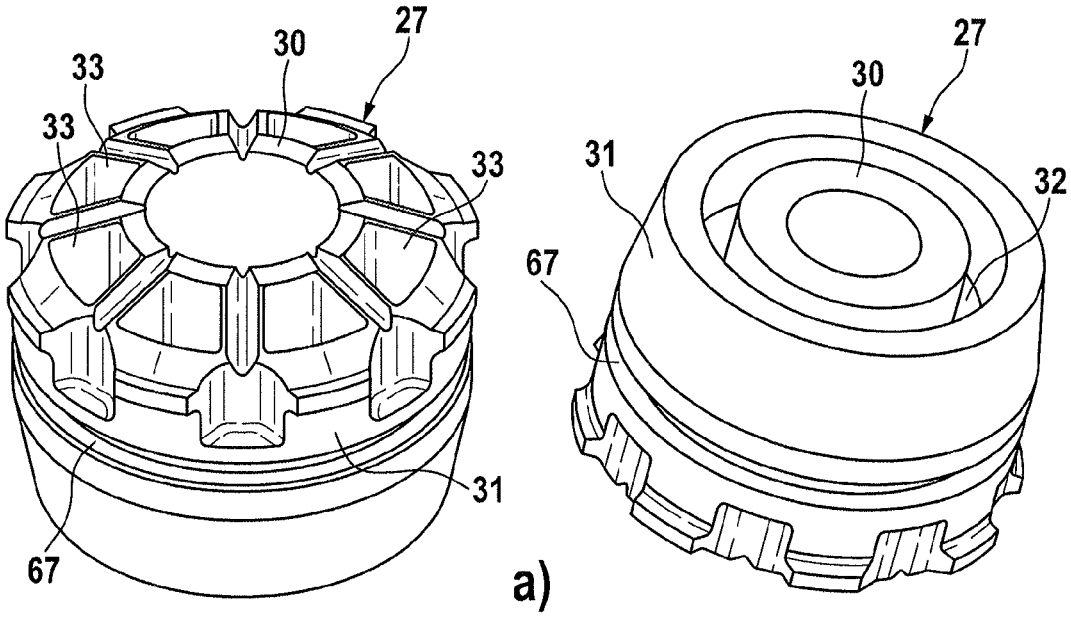
FIGS. 12*a* and 12*b* show an embodiment according to the invention of a damping element in a three-dimensional view and in a sectional view.
Figure 12:
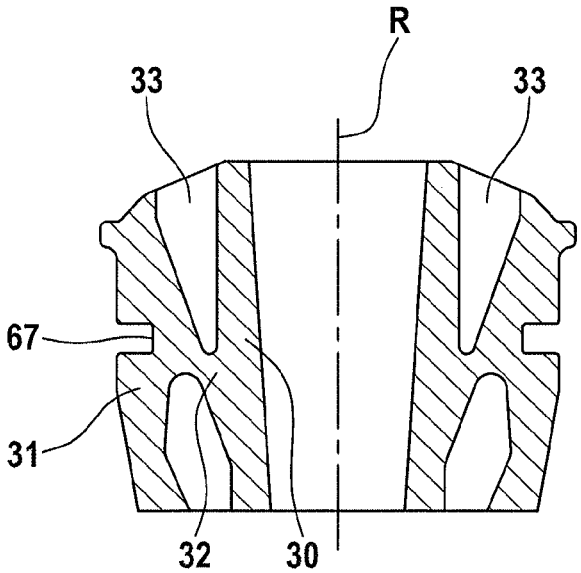

FIG. 12 illustrates a damping element 27 composed of elastic material, preferably EPDM or a silicone material, in a three-dimensional view (view a, obliquely from above and obliquely from below) and a sectional illustration (view b). Said damping element has an outer shell 31 and an inner shell 30, wherein the inner shell has a rotationally symmetrical inner contour which is of tubular conical form and which corresponds with above-described supporting elements 29, 29' of the base holder or with a further fastening element. On the outer shell 31 there is formed an encircling groove 67 which is suitable for the fixing of the damping element 27 in a bore in a suitable holding element.

The inner shell 30 is connected to the outer shell 31 via an encircling collar 32 that is arranged obliquely with respect to the axis of rotation R. Furthermore, the inner shell 30 is connected to the outer shell 31 via multiple webs 33 which are arranged on one side of the collar and which run radially from the inner shell 30 to the outer shell 31. Assisted by the conically running inner contour of the inner shell 30 together with the collar 32 and the webs 33, the damping element 27, under load, deforms both transversely and along or obliquely with respect to the axis of rotation R and generates a resistance force counter to the load, which resistance force is dependent on the degree of deformation and is initially weak (soft), increases progressively (hard) with increasing deformation, and is particularly high after a collapse of the free intermediate spaces between the inner shell 30 and the outer shell 31. In this way, small vibrations of the pump unit are intercepted in an effective manner by the "soft" part of the spring characteristic curve and are not transmitted to the body, and a relatively large movement of the pump unit is damped by the hard part of the spring characteristic curve, with effective decoupling thus being realized over a broad range.

FIG. 13

Figure 13:
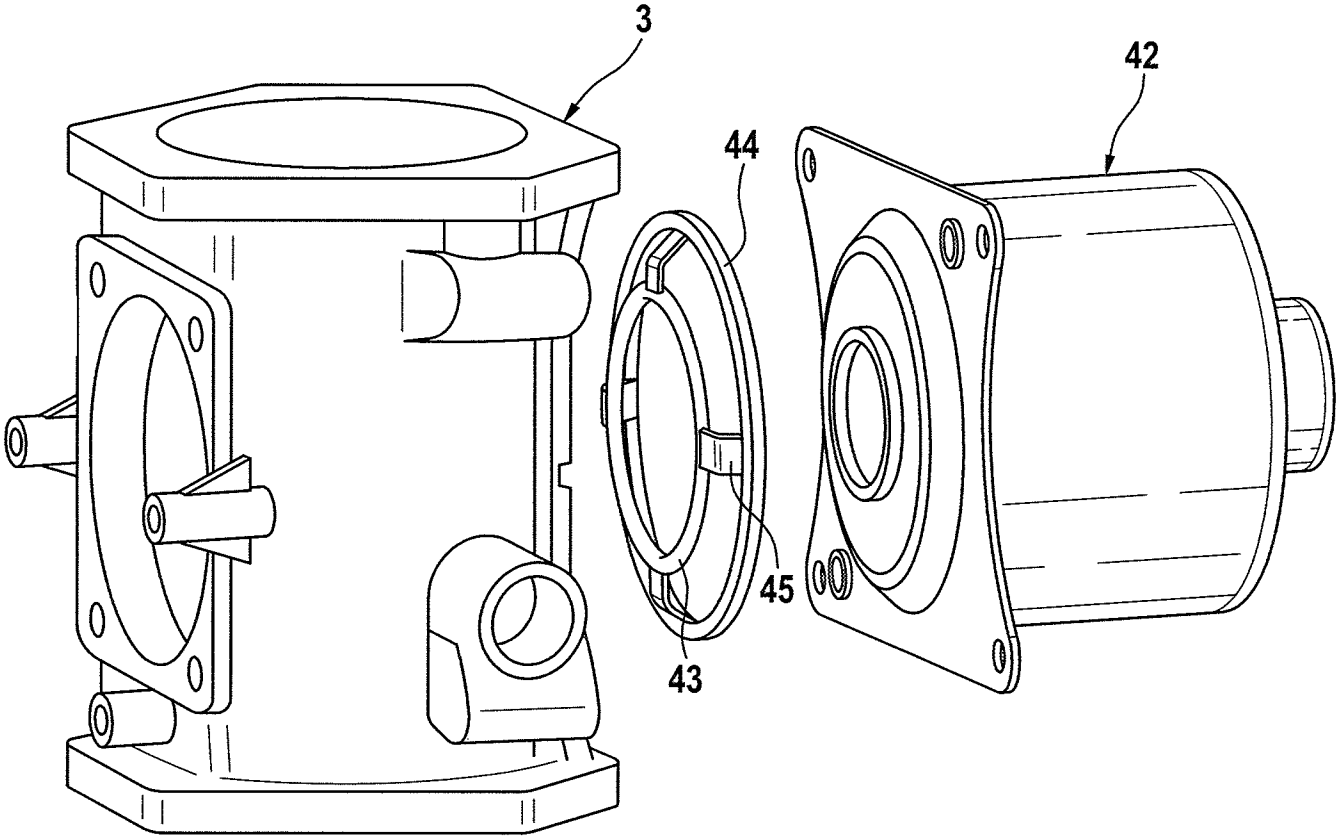
FIG. 13 shows an exploded illustration depicting the arrangement of elastic intermediate elements according to the invention between the pump housing and the drive unit.

The connecting point between the drive unit 42 and the pump housing 3 must be of both sealed and also vibration-decoupled design. In the embodiment according to the invention shown in FIG. 13, two elastic intermediate elements 43, 44 which are of substantially annular form and are arranged concentrically with respect to one another are provided between the pump housing 3 and the drive unit 42. The inner intermediate element 43 has a circular cross section and serves primarily for the sealing of the interface. The inner intermediate element 43 is connected to the outer intermediate element 44 via four connecting webs 45. Within the scope of the invention, some other number of connecting webs 45 is also possible. A further embodiment without connecting webs 45 is likewise conceivable.

The cross section of the outer intermediate element 44 and of the connecting webs 45 is preferably cuboidal, and in this case configured such that the outer intermediate element 44 and optionally also the connecting webs 45 are compressed between the pump housing 3 and the drive unit 42 when the pump unit 1 is in an assembled state. Here, a defined air gap remains between the pump housing 3 and the drive unit 42 at least in the region around the outer intermediate element 44. In this way, a transmission of vibrations between the drive unit 42 and the pump housing 3 is reduced by way of a conversion of the kinetic energy into heat, without the seal function being impaired.

FIG. 14

FIG. 14 shows an embodiment according to the invention of a displacement element 4. The displacement element 4 comprises an elastic diaphragm element 46 and a connecting rod element 47. The diaphragm element 46 is molded onto the connecting rod element 47 by insert molding, and is thus irreversibly connected thereto. To make it possible to realize a durable connection, the diaphragm element 46 has a material reinforcement in the region of the insert-molded portion, and the connecting rod element 47 has, in the insert-molded region, a shank head 50 with an aperture 51 in order to form an effective anchor and counteract a detachment of the diaphragm element 46 from the connecting rod element 47 during pump operation. Owing to the aperture 51, which after the insert molding process is filled with the material of the diaphragm element 46, it is not possible for the two parts to be separated from one another without being destroyed. Further designs of the aperture 51, and the provision of multiple apertures in the shank head 50, are also conceivable within the scope of the invention.

The connecting rod element 47 is of unipartite form and is composed substantially of a shank part 48 and of a connecting rod ring part 49 integrally formed on the shank part 48. The connecting rod element may preferably be produced from a plastics material in an injection molding process, although other production methods, for example punching or sintering, and metal materials are likewise possible.

REFERENCE SIGNS

1 Pump unit
2 Working chamber cover
3 Pump housing
4 Displacement element
5 Working chamber
6 Inlet valve
7 Outlet valve
8 Inlet duct
9 Outlet duct
10 Housing flange
11 Lower bottom cover flange
12 Top cover
13 Bottom cover
14 Top cover flange
15 Upper bottom cover flange
16 Molded protuberance
17 Decoupling element
18 Seal element
19, 19' Valve plate
20 Insert part
21 Locking opening
22, 22' Valve support surface
23 Recess
24 Air duct
25 Outer contour
26 Outer contour
27 Damping element
28 Base holder
29, 29' Supporting element
30 Inner shell
31 Outer shell
32 Collar
33 Web
34 Air outlet unit
35 Intermediate base
36 Passage opening
37 Tab
38 Check valve
39 Valve plate
40 Elastic element
41 Disk element
42 Drive unit
43 Inner intermediate element
44 Outer intermediate element
45 Connecting web
46 Diaphragm element
47 Connecting rod element
48 Shank part
49 Connecting rod ring part
50 Shank head
51 Aperture
52 Crank drive
53 Housing interior
54 Connection line
55 Combination seal
56 Impact element
57 Locking lug
58 Impact surface
60 Positioning stud
61 Stud guide
62 O-ring
63 Sleeve
64 Pin
65 Check valve seat
66 Air outlet unit base
67 Groove
R Axis of rotation

The invention claimed is:

1. A pump unit that can be driven by electric motor, for the generation of negative pressure for a pneumatic brake force booster, comprising a pump housing that can be closed off by a working chamber cover and comprising at least one elastic displacement element, wherein a working chamber is delimited between the displacement element and the working chamber cover, and said working chamber is assigned in each case inlet and outlet valves and inlet and outlet ducts assigned to the valves, at least three protuberances extending from one of the working chamber cover and the pump housing for reducing an area of contact between the working chamber cover and the pump housing, and a decoupling element positioned between the at least three protuberances extending from the one of the working chamber cover and the pump housing and the other one of the working chamber cover and the pump housing.

2. The pump unit that can be driven by electric motor as claimed in claim 1, wherein the at least three protuberances are distributed over the circumference of a housing flange, such that a spatially stable support is realized between the working chamber cover and the pump housing.

3. The pump unit that can be driven by electric motor as claimed in claim 1, wherein the working chamber cover has a top cover and a bottom cover with a lower bottom cover flange, and the at least three protuberances are distributed over the circumference of the lower bottom cover flange, such that a spatially stable support is realized between the working chamber cover and the pump housing.

4. The pump unit that can be driven by electric motor as claimed in claim 1, wherein the working chamber cover has a top cover with a top cover flange and has a bottom cover with an upper bottom cover flange, wherein the at least three protuberances are provided between the top cover and the bottom cover.

5. The pump unit that can be driven by electric motor as claimed in claim 4, wherein the at least three protuberances distributed over the circumference of the top cover flange or of the upper bottom cover flange, such that a spatially stable support is realized between the top cover and the bottom cover.

6. The pump unit that can be driven by electric motor as claimed in claim 2, wherein the working chamber cover is separated from the pump housing, and/or the top cover is separated from the bottom cover, by the decoupling element for the purpose of reducing a transmission of vibrations.

7. The pump unit that can be driven by electric motor as claimed in claim 6, wherein the elastic decoupling element is connected to at least one seal element to form a gasket.

8. The pump unit that can be driven by electric motor as claimed in claim 1, wherein at least one insert part that can be loaded in a valve opening direction by a valve plate is arranged, so as to be secured against rotation, in the inlet or the outlet duct.

9. The pump unit that can be driven by electric motor as claimed in claim 8, wherein the insert part has means for locking the insert part in corresponding locking openings, wherein the locking openings are provided in the bottom cover.

10. The pump unit that can be driven by electric motor as claimed in claim 8, wherein the insert part has at least one impact surface, which is rounded in a valve opening direction, for the abutment of the valve plate during the valve opening process.

11. The pump unit that can be driven by electric motor as claimed in claim 1, wherein the bottom cover has a valve support surface for the support of the valve plate in a closed valve state, wherein at least one recess for reducing an area of contact between the valve plate and the valve support surface is arranged in the valve support surface.

12. The pump unit that can be driven by electric motor as claimed in claim 1, wherein the pump unit can be fastened in elastically vibration-decoupled fashion in a base holder, wherein the elastic decoupling is realized by means of damping elements, wherein the base holder has supporting elements for receiving damping elements, and wherein at least one supporting element is manufactured by deformation of the base holder.

13. The pump unit that can be driven by electric motor as claimed in claim 1, wherein the pump unit can be fastened in elastically vibration-decoupled fashion in a base holder, wherein the elastic decoupling is realized by damping elements, wherein at least one of the damping elements has an inner shell with a conical inner contour and an outer shell, wherein the inner shell is connected to the outer shell by an encircling collar and by radial webs arranged at least on one side of the collar.

14. The pump unit that can be driven by electric motor as claimed in claim 1, wherein an air outlet unit, which is pneumatically connected to the outlet duct, for the discharge of the air into the surroundings of the pump unit is provided, wherein the air outlet unit has an intermediate base with at least one passage opening, wherein the intermediate base comprises means closing the passage openings, in watertight fashion in the direction of the outlet duct, in the manner of a check valve.

15. The pump unit that can be driven by electric motor as claimed in claim 14, wherein the means for closing passage openings are in the form of an elastically resilient tab that is integrally formed on the intermediate base.

16. The pump unit that can be driven by electric motor as claimed in claim 1, wherein an air outlet unit, which is pneumatically connected to the outlet duct, for the discharge of the air into the surroundings of the pump unit is provided, wherein the air outlet unit has a check valve with an elastic valve disk, and the check valve closes pneumatically in the direction of the outlet duct, wherein the valve disk is loaded counter to the valve opening direction by an elastic element.

17. The pump unit that can be driven by electric motor as claimed in claim 16, wherein a disk element is provided so as to be arranged between the elastic element and the valve disk.

18. The pump unit that can be driven by electric motor as claimed in claim 16, wherein the elastic element is in the form of a spiral spring.

19. The pump unit that can be driven by electric motor as claimed in claim 1, wherein the pump unit is driven by an electric drive unit, wherein at least two elastic intermediate elements are interposed, so as to act in parallel, between the pump housing and the drive unit, wherein an inner intermediate element is provided for pneumatic and hydraulic sealing with respect to the surroundings of the pump unit, and an outer intermediate element is provided for a vibration decoupling of the drive unit from the pump housing, and wherein the intermediate elements are connected to one another by at least two elastic connecting webs.

20. The pump unit that can be driven by electric motor as claimed in claim 1, wherein the displacement element has an elastic diaphragm element and a connecting rod element, wherein the diaphragm element is non-detachably connected to the connecting rod element by an insert molding process, wherein the connecting rod element is of unipartite form and has a shank part and a connecting rod ring part.

* * * * *